US011124387B2

(12) United States Patent
Kang et al.

(10) Patent No.: US 11,124,387 B2
(45) Date of Patent: Sep. 21, 2021

(54) END-FASTENING APPARATUS FOR LIFTING ROPE AND ELEVATOR SYSTEM USING THEREOF

(71) Applicant: Otis Elevator Company, Farmington, CT (US)

(72) Inventors: Kai Kang, Tianjin (CN); Qing Li, Tianjin (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 279 days.

(21) Appl. No.: 16/164,505

(22) Filed: Oct. 18, 2018

(65) Prior Publication Data

US 2019/0119070 A1 Apr. 25, 2019

(30) Foreign Application Priority Data

Oct. 20, 2017 (CN) ..... 201710982829.X

(51) Int. Cl.

*B66B 7/10* (2006.01)
*B66B 7/08* (2006.01)
*B66B 9/00* (2006.01)

(52) U.S. Cl.

CPC ..... *B66B 7/10* (2013.01); *B66B 7/08* (2013.01); *B66B 9/00* (2013.01)

(58) Field of Classification Search

CPC ..... B66B 7/10; B66B 7/08; B66B 7/06
See application file for complete search history.

(56) References Cited

U.S. PATENT DOCUMENTS 1,516,727 A * 11/1924 Hawkins ..... B66B 7/10 187/412
3,052,320 A 9/1962 Raymond
6,223,862 B1 5/2001 Barnes
7,798,290 B2 9/2010 Mustalahti et al.
7,806,237 B2 10/2010 Aulanko et al.
8,702,066 B2 4/2014 Steidinger et al.
(Continued)

FOREIGN PATENT DOCUMENTS

CN 2144177 Y 10/1993
CN 1178189 A 4/1998
(Continued)

OTHER PUBLICATIONS

European Search Report for Application No. 18201609.7; dated May 13, 2019; 7 pages.

*Primary Examiner* — Michael R Mansen
*Assistant Examiner* — Michelle M Lantrip
(74) *Attorney, Agent, or Firm* — Cantor Colburn LLP

(57) ABSTRACT

The present invention provides a pull rope head fixing apparatus and an elevator system using the same, and belongs to the technical field of elevators. The pull rope head fixing apparatus of the present invention is configured to simultaneously fix rope heads of N pull ropes that are arranged in parallel, and includes: a hydraulic cylinder body configured to form a hydraulic cylinder; N first hydraulic sub-cylinders arranged in parallel on the hydraulic cylinder body and communicated with the hydraulic cylinder; and first pistons each disposed corresponding to each of the first hydraulic sub-cylinders. The pull rope head fixing apparatus of the present invention can automatically balance the tensions of multiple pull ropes fixed by it.

18 Claims, 3 Drawing Sheets

(56) References Cited

U.S. PATENT DOCUMENTS

| | | | | |
|---|---|---|---|---|
| 9,156,655 | B2 | 10/2015 | Cao et al. | |
| 9,194,460 | B2 | 11/2015 | Jun | |
| 9,242,836 | B2 | 1/2016 | Cao et al. | |
| 2001/0025744 | A1* | 10/2001 | Ach | B66B 7/06 187/264 |
| 2006/0249337 | A1* | 11/2006 | McNamara | B66B 5/282 187/412 |
| 2012/0125720 | A1* | 5/2012 | Roberts | B66B 7/068 187/393 |
| 2016/0207736 | A1* | 7/2016 | Zhu | B66B 7/10 |

FOREIGN PATENT DOCUMENTS

| | | | | | |
|---|---|---|---|---|---|
| CN | 1993288 | A | | 7/2007 | |
| CN | 101506083 | A | | 8/2009 | |
| DE | 3720488 | A1 | * | 2/1988 | B66B 7/10 |
| FR | 2591580 | B1 | | 8/1990 | |
| GB | 191102822 | A | | 2/1912 | |
| GB | 919768 | A | | 2/1963 | |
| GB | 2183589 | A | * | 6/1987 | B66B 5/14 |
| JP | S5323448 | A | | 3/1978 | |
| KR | 20010088888 | A | | 9/2001 | |
| WO | 2011014165 | A1 | | 2/2011 | |
| WO | 2011055020 | A1 | | 5/2011 | |
| WO | 2013182209 | A1 | | 12/2013 | |
| WO | 2016146483 | A1 | | 9/2016 | |
| WO | 2017046889 | A1 | | 3/2017 | |

* cited by examiner

END-FASTENING APPARATUS FOR LIFTING ROPE AND ELEVATOR SYSTEM USING THEREOF

FOREIGN PRIORITY

This application claims priority to Chinese Patent Application No. 201710982829.X, filed Oct. 20, 2017, and all the benefits accruing therefrom under 35 U.S.C. § 119, the contents of which in its entirety are herein incorporated by reference.

TECHNICAL FIELD

The present invention belongs to the technical field of elevators, and relates to a pull rope head fixing apparatus that can automatically balance the tensions of multiple pull ropes and an elevator system using the same.

BACKGROUND ART

A pull rope is a common component in an elevator system, and is also a key component for the operation of the elevator system. The pull rope, when being driven by a tractor of the elevator system, can be used for lifting a car or the like.

At present, multiple pull ropes are generally used to lift a car simultaneously, especially when the pull ropes are flat ropes (e.g., steel belts) with the width of the cross section greater than the thickness thereof. As such, the multiple pull ropes are wound on, for example, a traction wheel and/or a sheave in parallel and may have different magnitudes of tensions respectively.

SUMMARY OF THE INVENTION

According to one aspect of the present invention, a pull rope head fixing apparatus for an elevator system is provided, which is configured to simultaneously fix rope heads of N pull ropes that are arranged in parallel, N being an integer greater than or equal to 2. The pull rope head fixing apparatus includes: a hydraulic cylinder body configured to form a hydraulic cylinder; N first hydraulic sub-cylinders arranged in parallel on the hydraulic cylinder body and communicated with the hydraulic cylinder; and first pistons each disposed corresponding to each of the first hydraulic sub-cylinders, wherein each of the first pistons is configured to fix a rope head of a corresponding pull rope and is movable in a corresponding first hydraulic sub-cylinder when the tension of the pull rope changes.

According to another aspect of the present invention, an elevator system is provided, including a car, a traction wheel, a sheave, and pull ropes configured to lift the car, and further including the pull rope head fixing apparatus, wherein the N pull ropes are wound on the traction wheel and the sheave in parallel, and N rope heads of at least one end of the N pull ropes are fixed to the pull rope head fixing apparatus.

The above features and operations of the present invention will become more apparent according to the following descriptions and accompanying drawings.

BRIEF DESCRIPTION OF THE DRAWINGS

The above and other objectives and advantages of the present invention will be more complete and clearer from the following detailed descriptions with reference to the accompanying drawings, wherein identical or similar elements are represented by using identical reference numerals.

DETAILED DESCRIPTION

Figure 1:
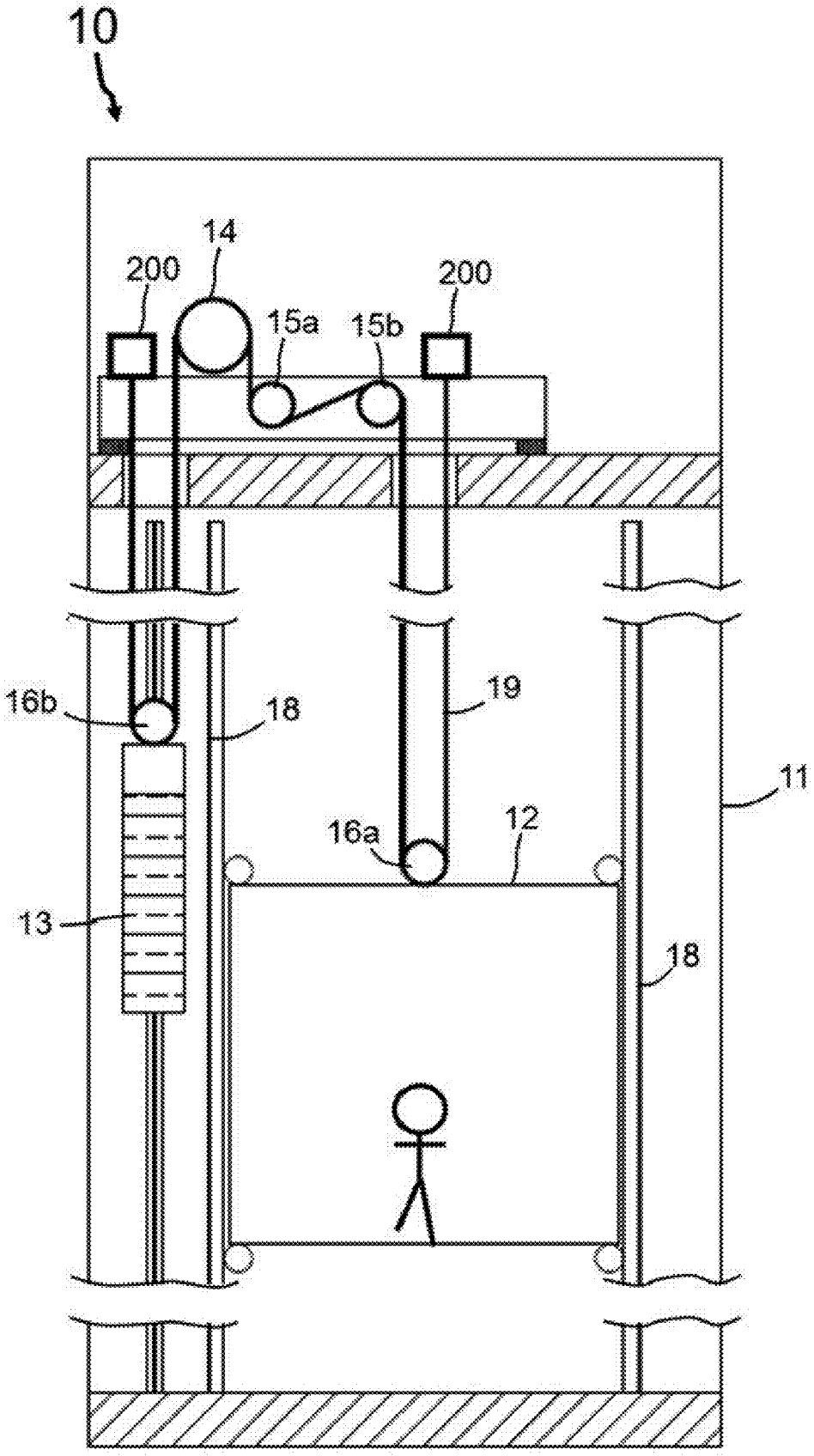
FIG. 1 is a schematic structural diagram of an elevator system according to an embodiment of the present invention.

Some of multiple possible embodiments of the present invention are introduced in the following to provide basic understanding of the present invention, and it is not intended to determine key or crucial elements of the present invention or limit the scope to be protected. It is easily understood that those of ordinary skill in the art can propose other replaceable implementation manners according to the technical solution of the present invention without changing the essential spirit of the present invention. Therefore, the following specific implementation manners and the accompanying drawings are merely exemplary illustrations on the technical solutions of the present invention and should not be considered as all of the present invention or considered as definitions or limitations to the technical solution of the present invention.

In this text, a "tension balanced state" of multiple pull ropes refers to that tensions of the multiple pull ropes, in a static state, basically keep a predetermined proportional relationship. The tensions of the multiple pull ropes are kept to be basically the same in a tension balanced state in most cases; however, the "tension balanced state" of the present invention is not limited to this case. For example, the predetermined proportion relationship can be adjusted and set according to special requirements.

The applicant also noticed that, for an elevator system that uses multiple pull ropes to lift a car, performance differences such as flexibilities of the multiple pull ropes or other reasons may easily result in that the tension is not kept balance between the multiple pull ropes (e.g., not kept equal), that is, the multiple pull ropes are in a tension unbalanced state. The unbalanced tension may easily cause a traction wheel and/or sheave on which the pull ropes are wound to be worn, and may also easily cause the pull ropes themselves to be worn, thus reducing the service lives of these components, and even affecting the operating quality (e.g., large noise and increased vibration) of the elevator system and/or reducing the safety performance of the system. Therefore, the tensions between the multiple pull ropes need to be adjusted manually to achieve a tension balanced state. The process is very time consuming and labor consuming. Moreover, as the elevator system operates, it is difficult to keep the tension balanced sate, and multiple adjustments are required continuously, thus resulting in a large maintenance workload.

Particular, when the pull rope is a flat pull rope (e.g., a flat steel belt or a flat fiber belt) with the width of the cross section greater than the thickness thereof, it is well-known by those skilled in the art that the flat pull rope has poorer rigidity but better flexibility than a round rope; therefore, on one hand, the flat pull rope is easily stretched to be longer, thus being especially easy to cause unbalanced tensions between multiple flat pull ropes; on the other hand, more (e.g., 7 or more) flat pull ropes arranged in parallel are needed in the same case, and it is more difficult to achieve the tension balance between the more flat pull ropes. In other words, the above problem is especially severe in an elevator system applying flat pull ropes.

Therefore, a pull rope head fixing apparatus and an elevator system in the following embodiments of the present invention are illustrated by taking the pull rope used being a flat pull rope as an example.

FIG. 1 shows a schematic structural diagram of an elevator system according to an embodiment of the present invention. As shown in FIG. 1, an elevator system 10 according to an embodiment of the present invention is concisely shown, and mainly includes a car 12, a traction wheel 14, sheaves 15 and 16, pull ropes 19 configured to lift the car 12, and a pull rope head fixing apparatus 200 which are uniformly arranged in a hoistway 11 of a building. The car 12 can travel vertically along a rail 18 arranged in the hoistway 11 or stop at a station. A corresponding tractor (not shown) is disposed corresponding to the traction wheel 14, and the tractor can drive the pull ropes 19 to lift the car 12.

In an embodiment, there may be multiple sheaves. For example, resistive sheaves 15*a* and 15*b* are included, and a return sheave 16*a* is also disposed corresponding to the car 12. When a counter-weight is used, the elevator system 10 further includes a counter-weight 13, and the sheave 15 further includes a return sheave 16*b* disposed corresponding to the counter-weight 13. It should be understood that the specific arrangements of the sheaves 15 and 16 are not limitative, and can be changed as a lifting method is changed.

In an embodiment, there are N (N is greater than or equal to 2, e.g., equal to 3) pull ropes 19. The N pull ropes 19 are respectively provided with a pull rope head fixing apparatus 200 to fix rope heads 191 at two ends thereof, thus being more conducive to implementing the tension balanced state of the N pull ropes 19. In another alternative embodiment, the pull rope head fixing apparatus 200 can also be disposed merely at one end of the N pull ropes 19.

Figure 2:
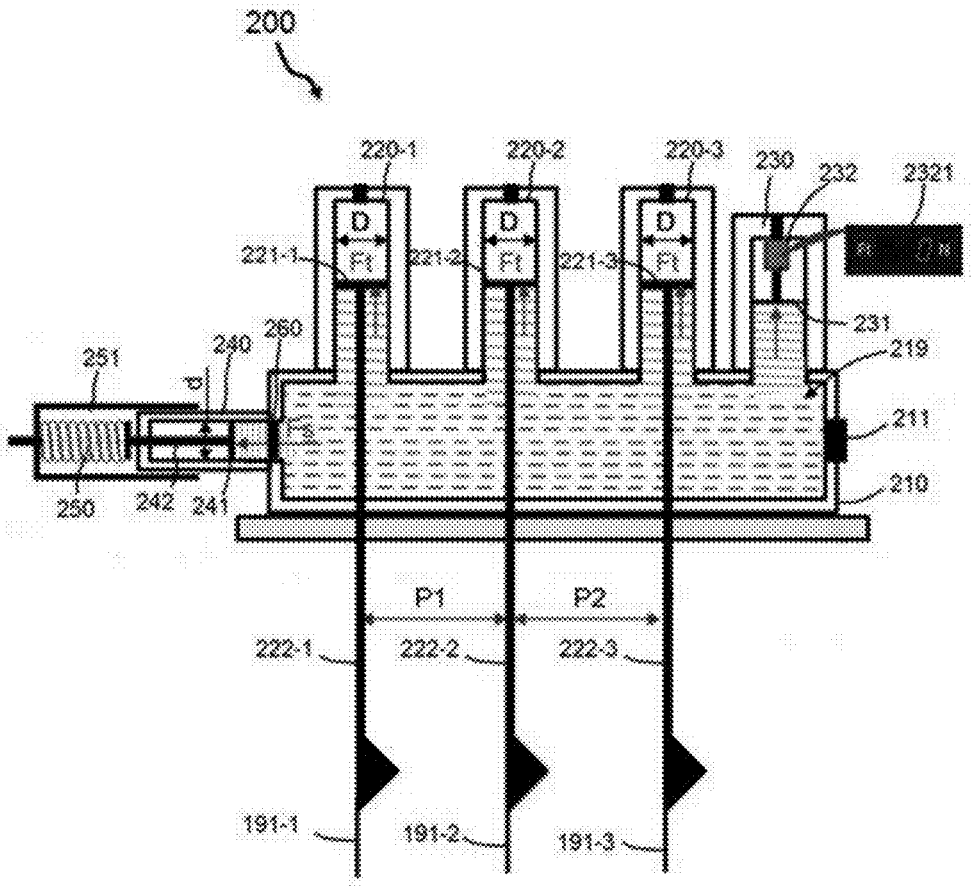
FIG. 2 is a schematic cross-sectional structural diagram of a pull rope head fixing apparatus according to an embodiment of the present invention.
Figure 3:
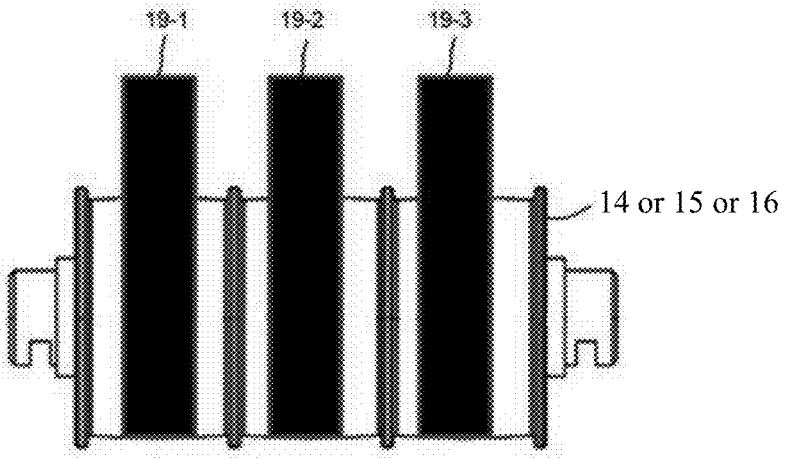
FIG. 3 schematically shows that pull ropes in the elevator system in the embodiment shown in FIG. 1 are wound on a sheave or traction wheel.
Figure 4:
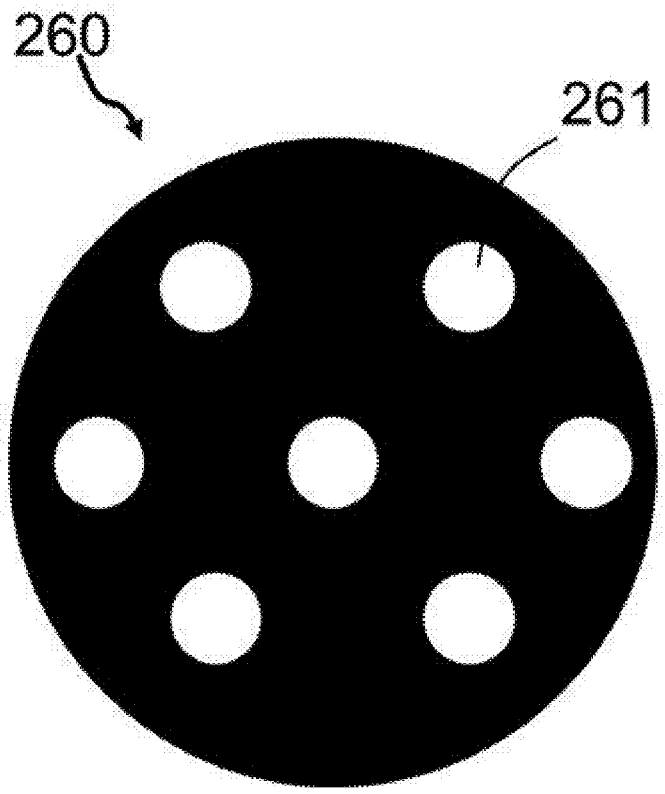
FIG. 4 is a schematic structural diagram of a damping plate used in the pull rope head fixing apparatus in the embodiment shown in FIG. 2.

FIG. 2 shows a schematic cross-sectional structural diagram of a pull rope head fixing apparatus according to an embodiment of the present invention. FIG. 3 schematically shows that pull ropes in the elevator system in the embodiment shown in FIG. 1 are wound on a sheave or a traction wheel. FIG. 4 shows a schematic structural diagram of a damping plate used in the pull rope head fixing apparatus shown in FIG. 2. Illustrations are further made below with reference to FIG. 1 to FIG. 4.

For simplicity, FIG. 2 and FIG. 3 merely show three pull ropes 19, i.e., N=3. However, as shown in FIG. 1 and FIG. 3, when the pull ropes 19 use flat pull ropes, the number of the pull ropes 19 that are wound in parallel on the traction wheel 14, the resistive sheave 15, and the return sheave 16 may be larger. As such, the traction wheel 14, the resistive sheave 15, and the return sheave 16 have large sizes in axial directions thereof, and it is also difficult to implement or keep equal tensions between the N pull ropes 19, e.g., it is difficult to keep the tension balanced state.

Still referring to FIG. 1 and FIG. 2, the pull rope head fixing apparatus 200 in the embodiment shown in FIG. 2 is fixedly mounted in the elevator system 10. Specifically, the pull rope head fixing apparatus 200 can be fixedly mounted in a machine room at the top of the hoistway 11. The pull rope head fixing apparatus 200 can be configured to simultaneously fix rope heads 191 of the N pull ropes 19 that are arranged in parallel. Specifically, the pull rope head fixing apparatus 200 mainly includes a hydraulic cylinder body 210, N first hydraulic sub-cylinders 220 (i.e., 220-1, 220-2, and 220-3), and first pistons 221 each disposed corresponding to each first hydraulic sub-cylinder 220. For example, a first piston 221-1 is disposed in a first hydraulic sub-cylinder 220-1 and can make a piston movement, a first piston 221-2 is disposed in a first hydraulic sub-cylinder 220-2 and can make a piston movement, and a first piston 221-3 is disposed in a first hydraulic sub-cylinder 220-3 and can make a piston movement.

Specifically, the hydraulic cylinder body 210 can form a hydraulic cylinder 219 in a closed manner Specifically, the hydraulic cylinder body 210 can be fixedly mounted in a basically horizontal manner. An accommodation chamber of the hydraulic cylinder 219 accommodates hydraulic oil, and the hydraulic oil can be injected or discharged through an oil hole 211 disposed on the hydraulic cylinder body 210. The specific liquid type of the hydraulic oil is not limited. Still referring to FIG. 2, the N first hydraulic sub-cylinders 220 are arranged in parallel on the hydraulic cylinder body 210 and are communicated with the hydraulic cylinder 219. In other words, the N first hydraulic sub-cylinders 220 are communicated with the hydraulic cylinder 219, thus forming a through chamber in the hydraulic cylinder body 210. By using hydraulic attributes, a hydraulic force Ft can be transmitted to each first piston 221 in the through chamber simultaneously, and the magnitude of the hydraulic force Ft is related to the area of the first piston 221. Definitely, each first piston 221 can also transmit the tension from the pull rope 19 to the hydraulic oil in the through chamber.

Each first piston 221 fixes a rope head 191 of a corresponding pull rope 19. For example, the first piston 221-1 fixes a rope head 191-1 at one end of the pull rope 19-1, the first piston 221-2 fixes a rope head 191-2 at one end of the pull rope 19-2, and the first piston 221-3 fixes a rope head 191-3 at one end of the pull rope 19-3. In an embodiment, a piston rod 222 (e.g., a piston rod 222-1 or 222-3 or 222-3) is disposed corresponding to each first piston 221. A first end of the piston rod 222 is connected to the corresponding first piston 221, and a second end of the piston rod 222 is connected to the rope head 191 of the corresponding pull rope 19. Specifically, for example, a clamp can be disposed at the second end of the piston rod 222 to fix the rope head 191. Therefore, when the tension of each pull role 19 is changed, the corresponding first piston 221 can move in the corresponding first hydraulic sub-cylinder 220.

According to a tension ratio of the pull ropes 19-1, 19-2, and 19-3 in the tension balanced state, piston areas of the first hydraulic sub-cylinders 220-1, 220-2, and 220-3 can be preset. For example, piston areas of the first piston 221-1, the first piston 221-2, and the first piston 221-3 are set. If the tension ratio is equal to 1 (i.e., the tensions are equal), the piston areas of the first piston 221-1, the first piston 221-2, and the first piston 221-3 are constructed to be equal. Specifically, for example, the first hydraulic sub-cylinders 220-1, 220-2, and 220-3 are all cylindrical cylinders, and inner diameters of the first hydraulic sub-cylinders 220-1, 220-2, and 220-3 are all set to D. In other words, a ratio of the inner diameters is equal to 1. Therefore, the first hydraulic sub-cylinders 220-1, 220-2, and 220-3 can be constructed into sub-cylinders having the same structure.

In an embodiment, still referring to FIG. 2, the first hydraulic sub-cylinders 220-1, 220-2, and 220-3 are all arranged vertically and protruded upward, and they can be arranged in parallel. Moreover, two adjacent first hydraulic sub-cylinders of the first hydraulic sub-cylinders 220-1,

220-2, and 220-3 have a basically equal center spacing P1 and P2. That is, the spacing between central axes of every two adjacent first hydraulic sub-cylinders is basically P1 and P2.

Therefore, even if the tensions between the N pull ropes 19 are unbalanced, e.g., unequal, at a certain instant, the pull rope head fixing apparatus 200 in the embodiment shown in FIG. 2 can balance the hydraulic forces Ft between the N first pistons 221 in the through chamber, such that the tensions between the N pull ropes 19 are restored quickly or tend to be equal, that is, the tension balanced state is restored. Therefore, dynamic balance of the tensions between the N pull ropes 19 is implemented automatically in the operating process of the elevator system. The use of the pull rope head fixing apparatus 200 avoids the processes of manually detecting the tensions of the N pull ropes 19 and manually adjusting the tensions, thus greatly reducing maintenance operating state. Meanwhile, the pull ropes 19 in the tension balanced state are also conducive to prolonging the service lives of the traction wheel 14, the resistive sheaves 15*a* and 15*b*, and the return sheaves 16*a* and 16*b*. The service lives of the multiple parallel pull ropes 19 are also more uniform.

Still referring to FIG. 2, in an embodiment, the pull rope head fixing apparatus 200 further includes: a second hydraulic sub-cylinder 240 arranged on the hydraulic cylinder body 210 and communicated with the hydraulic cylinder 219, a second piston 241 disposed corresponding to the second hydraulic sub-cylinder 240, and an elastic component 250 connected to piston rod 242. At least one end of the elastic component 250 receives a hydraulic force Fs transmitted from the hydraulic cylinder 219 by the second piston 241, and meanwhile applies a bounce from the elastic component 250 to the second piston 241. In other words, the hydraulic force Fs and the bounce form an acting force and a counter-acting force.

The specific magnitude of the hydraulic force Fs depends on the intensity of pressure of the hydraulic oil in the through chamber in the hydraulic cylinder 210 with which the second hydraulic sub-cylinder 240 is communicated, and the magnitude of the intensity of pressure is affected by the magnitude of the tension between the pull ropes 19. For example, when the elevator system is braked to stop, the tension of each pull rope 19 may be increased instantly, each first piston 221 transmits the tension from the pull rope 19 to the hydraulic oil in the through chamber, and the intensity of pressure of the hydraulic oil is increased. Further, the hydraulic force Fs received by the second piston 241 in, for example, the increased pressure condition is also increased correspondingly, such that a force (basically equal to Fs) applied by the second piston 241 to the elastic component 250 is also increased. Meanwhile, the elastic component 250 is compressed to generate a larger bounce to the second piston 241 until a balance is achieved. Therefore, the elastic component 250 can absorb energy from the pull ropes 19-1, 19-2, and 19-3, reduce the instant maximum tension of the pull ropes 19-1, 19-2, and 19-3, and/or alleviate the tension changes in the pull ropes 19-1, 19-2, and 19-3, thereby reducing the stretch length of the pull ropes 19-1, 19-2, and 19-3 and/or alleviating the stretch length changes in the pull ropes 19-1, 19-2, and 19-3, reducing the vibration amplitude of the car 12, and improving use experience of passengers. It will be understood that the elastic component 250 can be, for example, but is not limited to, an energy absorption component such as a spring.

The specific magnitude of the hydraulic force Fs further depends on the area size of the second piston 241. The area of the second piston 241 can be determined by calculation according to the elastic coefficient of the elastic component 250, the area of the first piston 221, and the like. Specifically, for example, the second hydraulic sub-cylinder 240 can be configured into a cylindrical shape, and the area of the second piston 241 can be determined by determining an inner diameter d of the second hydraulic sub-cylinder 240 through calculation. For example, the second hydraulic sub-cylinder 240 can be disposed to be protruded leftward horizontally.

Still referring to FIG. 2, in an embodiment, the pull rope head fixing apparatus 200 further includes a sleeve 251 fixedly disposed corresponding to the second hydraulic sub-cylinder 240. The elastic component 250 is disposed in the sleeve 251 and is located between a closed end of the sleeve 251 and the second piston 241. The length between an outer end of the second hydraulic sub-cylinder 240 and the closed end of the sleeve 251 is predetermined.

Still referring to FIG. 2 and FIG. 4, in an embodiment, the pull rope head fixing apparatus 200 further includes a damping plate 260 configured to alleviate changes in the hydraulic force Fs transmitted from the hydraulic cylinder 219 to the second piston 241. The damping plate 260 and the second piston 241 are arranged in the second hydraulic sub-cylinder 240 basically in parallel. One or more circulation holes 261 can be disposed on the damping plate 260. An area proportion of all the circulation holes 261 on the damping plate 260 depends on the degree of alleviating the changes in the hydraulic force Fs. A higher proportion leads to a lower alleviation degree, and a lower proportion leads to a higher alleviation degree. In an embodiment, as shown in FIG. 4, the multiple circulation holes 261 are dispersed on the damping plate 260 basically uniformly.

In a process that the intensity of pressure of the hydraulic oil in the hydraulic cylinder 219 is increased, the hydraulic force Fs received by the second piston 241 is also increased correspondingly in, for example, the condition of an increased intensity of pressure, such that the second piston 241 moves leftward. At this instant, the damping plate 260 can reduce the speed of the hydraulic oil being injected into the space between the damping plate 260 and the second piston 241 through the circulation holes 261. Therefore, the increase of the hydraulic force Fs transmitted to the second piston 241 is slowed down. Similarly, in a process that the intensity of pressure of the hydraulic oil in the hydraulic cylinder 219 is reduced, the damping plate 260 slows down the reduction of the hydraulic force Fs transmitted to the second piston 241. Therefore, the damping plate 260 can alleviate the changes in the hydraulic force Fs transmitted from the hydraulic cylinder 219 to the second piston 241, further reduce the changes in the stretch lengths of the pull ropes 19-1, 19-2, and 19-3, reduce the vibration amplitude of the car 12, and further improve the experience of passengers.

In an embodiment, as shown in FIG. 2, the pull rope head fixing apparatus 200 further includes a tension detection component 232. The tension detection component 232 can, for example, indirectly detect the magnitude of the tension of the pull rope 19 in real time. The tension value can be sent to a control component of the elevator system 10 to be used for, e.g., calculating a pre-torque or controlling a tractor. It should be understood that the tensions of the N pull ropes 19 keep in a predetermined proportional relationship, e.g., keep being basically the same; therefore, the magnitudes of the tensions detected by the tension detection component 232 also reflect the tension values of the N pull ropes 19.

Specifically, corresponding to the tension detection component 232, a third hydraulic sub-cylinder 230 in communication with the hydraulic cylinder 219 can be arranged on the hydraulic cylinder body 210, and a third piston 231 disposed corresponding to the third hydraulic sub-cylinder 230 is further arranged. The tension detection component 232 is disposed on a piston rod of the third piston 231. During detection, the third piston 231 receives a hydraulic force transmitted from the hydraulic oil in the through chamber, and transmits the hydraulic force to the piston rod. The hydraulic force is then detected by the tension detection component 232. When the piston area of the third piston 231 is known, the hydraulic force Ft can be calculated based on the hydraulic force, such that the magnitudes of the tensions of the N pull ropes 19 can be obtained by calculation. Therefore, in the pull rope head fixing apparatus 200 according to the embodiment of the present invention, the magnitudes of the tensions of the N pull ropes 19 can be detected conveniently; this is obviously different from the prior art in which the magnitudes of the tensions of the multiple pull ropes 19 may be different and need to be detected manually, which is very time consuming and labor consuming.

In an embodiment, as shown in FIG. 2, the tension detection component 232 can have a display apparatus 2321 configured to display the magnitude of the tension detected, thus facilitating an operator to read the magnitude of the tension.

It should be noted that the pull rope 19 used in the above embodiments of the present invention can be, for example, a flat steel belt formed by wrapping multiple steel wires with polyurethane, or can be a flat carbon fiber belt. However, the pull rope can also be other various types of flat ropes with the width of the cross section greater than the thickness of the cross section, or even can be various flat ropes developed subsequently after the present application. As for a flat steel belt, a major reinforcing component for carrying is a steel wire or a steel rope, and can further include, for example, a wrap layer using polyurethane and the like, or even can further include other reinforcing fibers or the like arranged in a longitudinal direction of the rope to serve as assistant reinforcing components. As for a flat carbon fiber belt, a major reinforcing component for carrying is a carbon fiber or other reinforcing fibers having performances similar to that of the carbon fibers. Definitely, it should be understood that the flat carbon fiber belt can, but is not limited to, include a substrate material configured to distribute or fix carbon fibers, and the carbon fibers are fixedly distributed in the substrate material to form the major carrying component of the flat fiber belt. It should be further understood that, in addition to assistant fibers, the flat carbon fiber belt can further include other types of reinforcing fibers or the like arranged in a longitudinal direction of the rope to serve as assistant reinforcing components.

The above examples mainly illustrate the pull rope head fixing apparatus and the elevator system using the same according to the present invention. Merely some implementation manners of the present invention are described; however, those of ordinary skill in the art should understand that the present invention can be implemented in many other forms without departing from the substance and scope of the present invention. Therefore, the presented examples and implementation manners are considered as illustrative rather than limitative. The present invention can cover various modifications and replacements without departing from the spirit and scope of the present invention defined by the appended claims.

What is claimed is:

1. A pull rope head fixing apparatus for an elevator system, configured to simultaneously fix rope heads of N pull ropes that are arranged in parallel, N being an integer greater than or equal to 2, the pull rope head fixing apparatus comprising:

a hydraulic cylinder body configured to form a hydraulic cylinder;

N first hydraulic sub-cylinders arranged in parallel on the hydraulic cylinder body and communicated with the hydraulic cylinder;

first pistons each disposed corresponding to each of the first hydraulic sub-cylinders, wherein each of the first pistons is configured to fix a rope head of a corresponding pull rope and is movable in a corresponding first hydraulic sub-cylinder when the tension of the pull rope changes;

a second hydraulic sub-cylinder arranged on the hydraulic cylinder body and communicated with the hydraulic cylinder;

a second piston disposed corresponding to the second hydraulic sub-cylinder;

an elastic component, at least one end of the elastic component receiving a hydraulic force of the hydraulic cylinder transmitted from the second piston while applying a bounce to the second piston;

a tension detection component;

a third hydraulic sub-cylinder arranged on the hydraulic cylinder body and communicated with the hydraulic cylinder; and a third piston disposed corresponding to the third hydraulic sub-cylinder, wherein the tension detection component is disposed on a piston rod of the third piston.

2. The pull rope head fixing apparatus according to claim 1, further comprising a sleeve disposed fixedly corresponding to the second hydraulic sub-cylinder, wherein the elastic component is disposed in the sleeve and located between a closed end of the sleeve and the second piston.

3. The pull rope head fixing apparatus according to claim 1, further comprising:

a damping plate configured to alleviate changes in the hydraulic force transmitted to the second piston.

4. The pull rope head fixing apparatus according to claim 3, wherein the damping plate and the second piston are arranged basically in parallel in the second hydraulic sub-cylinder.

5. The pull rope head fixing apparatus according to claim 3, wherein one or more circulation holes are disposed on the damping plate.

6. The pull rope head fixing apparatus according to claim 5, wherein the multiple circulation holes are dispersed basically uniformly on the damping plate.

7. The pull rope head fixing apparatus according to claim 1, wherein a piston area of the N first hydraulic sub-cylinders is determined according to a tension ratio of the N pull ropes in a tension balanced state.

8. The pull rope head fixing apparatus according to claim 7, wherein the N first hydraulic sub-cylinders are all cylindrical, and a ratio of inner diameters of the N first hydraulic sub-cylinders is equal to the tension ratio.

9. The pull rope head fixing apparatus according to claim 7, wherein the tension ratio is equal to 1.

10. The pull rope head fixing apparatus according to claim 1, wherein a piston rod is disposed corresponding to each of the first pistons, a first end of the piston rod is connected to the corresponding first piston, and a second end of the piston rod is connected to a rope head of the corresponding pull rope.

11. The pull rope head fixing apparatus according to claim 1, wherein the N first hydraulic sub-cylinders are arranged in parallel and protruded upward vertically, and a basically equal center spacing is provided between two adjacent first hydraulic sub-cylinders of the N first hydraulic sub-cylinders.

12. The pull rope head fixing apparatus according to claim 1, wherein the tension detection component has a display apparatus configured to display the magnitude of a tension detected.

13. The pull rope head fixing apparatus according to claim 1, wherein the width of a cross section of the pull rope is greater than the thickness of the cross section.

14. The pull rope head fixing apparatus according to claim 13, wherein the pull rope is a flat steel belt or a flat fiber belt.

15. An elevator system, comprising a car, a traction wheel, a sheave, and a pull rope configured to lift the car, and further comprising the pull rope head fixing apparatus according to claim 1, wherein the N pull ropes are wound on the traction wheel and the sheave in parallel, and N rope heads of at least one end of the N pull ropes are fixed to the pull rope head fixing apparatus.

16. The elevator system according to claim 15, wherein the N pull ropes dynamically keep tension balance in an operating process of the elevator system.

17. The elevator system according to claim 15, wherein the pull rope head fixing apparatus is disposed respectively at two ends of the N pull ropes.

18. The elevator system according to claim 15, further comprising a counter-weight, wherein the pull ropes are further configured to lift the counter-weight.

* * * * *